United States Patent [19]

Jansen et al.

[11] Patent Number: 4,803,865

[45] Date of Patent: Feb. 14, 1989

[54] STAND-SUPPORTED BENDING DEVICE FOR AXIALLY SLIDABLE ROLLS OF A MULTIROLL ROLLING MILL

[75] Inventors: Johannes Jansen, Hilchenbach; Friedel Mogendorf, Duisburg; Karl-Heinz Simon, Langenfeld, all of Fed. Rep. of Germany

[73] Assignee: SMS Schloemann—Siemag Aktiengesellschaft, Dusseldorf, Fed. Rep. of Germany

[21] Appl. No.: 74,794

[22] Filed: Jul. 17, 1987

[51] Int. Cl.[4] ..... B21B 31/18; B21B 31/32

[52] U.S. Cl. ..... 72/245; 72/243; 72/247

[58] Field of Search ..... 72/245, 247, 243, 241, 72/248

[56] References Cited

U.S. PATENT DOCUMENTS

| | | | |
|---|---|---|---|
| 3,857,279 | 6/1971 | Sendzimir | 72/245 X |
| 4,516,491 | 5/1985 | Winter | 72/243 X |

FOREIGN PATENT DOCUMENTS

| | | | |
|---|---|---|---|
| 0354396 | 6/1922 | Fed. Rep. of Germany | 72/245 |
| 2804007 | 8/1979 | Fed. Rep. of Germany | 72/245 |
| 0059417 | 1/1985 | Fed. Rep. of Germany . | |
| 3331055 | 3/1985 | Fed. Rep. of Germany . | |
| 0026903 | 1/1986 | Fed. Rep. of Germany . | |
| 0153505 | 9/1984 | Japan | 72/247 |
| 2024682 | 1/1980 | United Kingdom | 72/245 |

*Primary Examiner*—Robert L. Spruill
*Assistant Examiner*—Steven B. Katz
*Attorney, Agent, or Firm*—Herbert Dubno

[57] ABSTRACT

The stand-supported bending device for the axially slidable rolls of a rolling mill comprises at least one bending cylinder whose piston acts on a mount of a slidable roll provided with an intermediate piece guided tilt-free in a supporting block covering one or more of the pistons. The intermediate piece is provided with a mount facing planar pressing surface. Since the opposing pressing surface is located on the mount, e.g. on laterally extending engaging lugs of the mount, symmetric to the transverse central plane of a radial bearing of the mount, the bending force acts continuously on this mount in this central plane whose lateral relative position the mount of the axially slidable rolls may take relative to the bending device. The tilt-free guiding which absorbs the tilting torque or moment of the intermediate piece can be improved by a mechanical or hydraulic synchronizing device. Then the pistons are no longer exposed to transverse forces due to the axial sliding of rolls and/or their mounts. All hydraulic connections are made rigidly.

20 Claims, 13 Drawing Sheets

R
HS
HL1
HL2
3a
1
M
42a
S
36
34
35
33
56
42
50
43
16
32
51
44
45
57
S
M
4a
2

STAND-SUPPORTED BENDING DEVICE FOR AXIALLY SLIDABLE ROLLS OF A MULTIROLL ROLLING MILL

FIELD OF THE INVENTION

Our present invention relates to a stand-supported bending device for the axially slidable rolls of a multiroll rolling mill and, more particularly, to a stand-supported bending device for the axially slidable rolls of a rolling mill with four or more rolls.

BACKGROUND OF THE INVENTION

A bending device for the axially slidable rolls of a multiroll rolling mill with four or more rolls can be located in one of a plurality of supporting blocks horizontally and vertically guiding the mounts for the slidable rolls and comprises at least one bending cylinder with a hydraulically actuated piston for each block which transmits the bending forces to a mount, e.g. to laterally extended lugs of the mount.

This stand-supported bending device which is described in European Pat. No. 59 417 cannot follow the axial motion of the rolls and their mounts, also it does not "wander with" or follow the rolls.

More recent developments are directed to roll-fixed bending devices (European Patent publicationopen application No. 26 903, German Patent Document- Open Application No. 33 31 055 and one example in the above-mentioned European Pat. No. 59 417).

By a roll-fixed bending device, we mean a bending device with which the bending force applied in every possible axial position of the rolls, particularly the working rolls, acts on the mounts or the built-in components with a continuous constant effect. An additional basis for requiring the bending device to move with the axial sliding rolls is that such a bending device keeps the pistons of the bending device free of transverse forces, which could arise because of shifts between the plunger-like pistons and the mounts, supports and/or their laterally extending engaging lugs when these are fixed in position and/or held in place. The development of roll-fixed bending devices has however led to complicated and expensive structures.

OBJECTS OF THE INVENTION

It is an object of our invention to provide an improved stand-supported bending device for the axially slidable rolls of a multiroll rolling mill which will obviate these drawbacks.

It is another object of our invention to provide an improved stand-supported bending device for the axially slidable rolls of a multiroll rolling mill in Which the supporting pistons of the bending device are kept free of transverse forces, but which is comparatively simple and inexpensive.

It is also an object of our invention to provide an improved stand-supported bending device for the axially slidable rolls of a multiroll rolling mill in which the supporting pistons of the bending device are not only maintained free of transverse forces, but also guarantee a continuous, constant and tilt-free transfer of the bending force to the mount or mounts which nevertheless are axially slidable with the rolls.

SUMMARY OF THE INVENTION

These objects and others which will become more readily apparent hereinafter are attained, in accordance with our invention, in a bending device for the axially slidable rolls of a multiroll rolling mill with four or more rolls which is located in at least one supporting block guiding the mounts for the slidable rolls horizontally and vertically and comprises at least one bending cylinder with a hydraulically actuated piston for each block which transmits the bending forces to a mount, e.g. to at least two laterally extending engaging lugs of the mount.

According to our invention, an intermediate piece is positioned between the piston and the mount. This intermediate piece has a planar, substantially horizontal pressing surface parallel to the roll axes on its end projecting from the block which extends horizontally at least over length of the maximum axial displacement of the slidable rolls. The mount is provided with an opposing pressing surface for receiving the bending forces which is located at least in the vicinity of the transverse central plane of a radial bearing of the mount.

By an intermediate piece, we mean a plunger-like end piece or pressing bridge member which is in a position between a bending cylinder and a mount for the rolls.

One or more pistons acting in the same direction are covered on their plunger-like ends by an intermediate piece according to our invention in such manner that they are kept free of transverse forces resulting from sliding of the rolls and their mounts. It is also guaranteed that the bending force acts in the transverse central plane of the radial bearing of a mount continuously in each relative position of the mount-facing opposing pressing surface pressing against the planar pressing surface of the intermediate piece.

If the direction of the transmitted bending forces is outside the perpendicular symmetry plane of the piston or pistons, the tilting torque or moment which acts on the intermediate piece is absorbed by this tilt-free guidance.

To assist the bending of the rolls and to compensate for any tilting motion connected with it, the opposing pressing surface on each mount is advantageously spherical and formed as a replaceable wear piece.

To apply comparatively small bending forces one piston for each supporting block is enough. In this case a tilt-free guidance of the intermediate piece is provided when two guiding members spaced from each other in the direction of the roll axes are provided on each intermediate piece symmetrically to the symmetry plane of the piston. When the intermediate pieces are constructed as pressing bridge members or yokes these guiding members can include advantageously round guide bolts which are manufactured very precisely as are their guide passages and take the tilting torque or moment or other torques satisfactorily.

For the case in which a larger bending device with a pair of pistons acting in the same direction for each supporting block is provided, a central bolt located in the symmetry plane of the pistons in each of the intermediate pieces formed as a pressing bridge member provides tilt-free guiding of the pressing bridge member.

To relieve to a certain extent, the necessity of tilt-free guidance of the intermediate piece and to prevent increased wear, our invention provides that each intermediate piece can be coupled to its guide members spaced from each other or to the round guide bolts by a positively actuated mechanical synchronizing device.

Advantageously, the positively actuated mechanical synchronizing device comprises rack and pinion gearing which has at least one linear toothed member or rack and at least one pinion meshing therewith.

Also each synchronizing device can comprise at least two pinions attached coaxially and rigidly by a shaft and two linear toothed members or racks meshing with it.

The pinions can be mounted on a common shaft freely rotatable in the block while the racks can be locally fixed on the vertically slidable end pieces. Alternatively, the pinions can be mounted so as to be freely rotatable on their common shaft in one of the end pieces while the racks are locally fixed on the blocks.

As is important for optimum guiding, each end piece can have guiding members directed downwardly or into the block which are guidable past the bending cylinder inside the block.

In another embodiment of the bending device of our invention, the hydraulically activated pistons of the bending cylinder can be engaged on the end pieces by the synchronizing device—also indirectly. The synchronizing device forms an operating part of the bending device in this case.

In a bending device in which the shaft with the pinions of the synchronizing device is rotatably mounted in the end pieces and the linear toothed members are locally fixed in the blocks, the hydraulically actuated piston of the bending cylinder can engage on a lever arm rotatably attached with the shaft. The rotating drive of the shaft thus guarantees not only the synchronized motion of the end pieces, but it also exerts the bending force on the mounts supported on the end pieces.

In another embodiment of the bending device according to our invention, the shaft with the pinions of the synchronizing device is rotatably mounted on a sliding piece and each pinion is engaged with a rack on the slidable end pieces on one side and diametrically opposed on the other side with a rack in the locally fixed block.

The racks of a mechanical synchronization device can be located on two round guide bolts of a pressing bridge member and these guide bolts can be pivotally connected to the pressing bridge member to avoid forces on and bending tension in the round bolts.

Such a bending device is particularly suitable when comparatively large displacements of the end pieces are to be provided using bending cylinders with comparatively small displacements.

Instead of a mechanical synchronizing device to provide the tilt-free guiding of intermediate pieces also a hydraulic synchronizing device can be used for two pistons acting in the same direction in which the bending force for each one of the pair of pistons acting in the same direction associated with intermediate pieces (end piece or pressing bridge member) is changeable so that during a shift of the central plane of the radial bearing of a mount from the symmetry plane of the piston, because of an axial shift of the rolls, the lateral guiding members and/or round bolts are guided moment-free in the associated supporting block.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
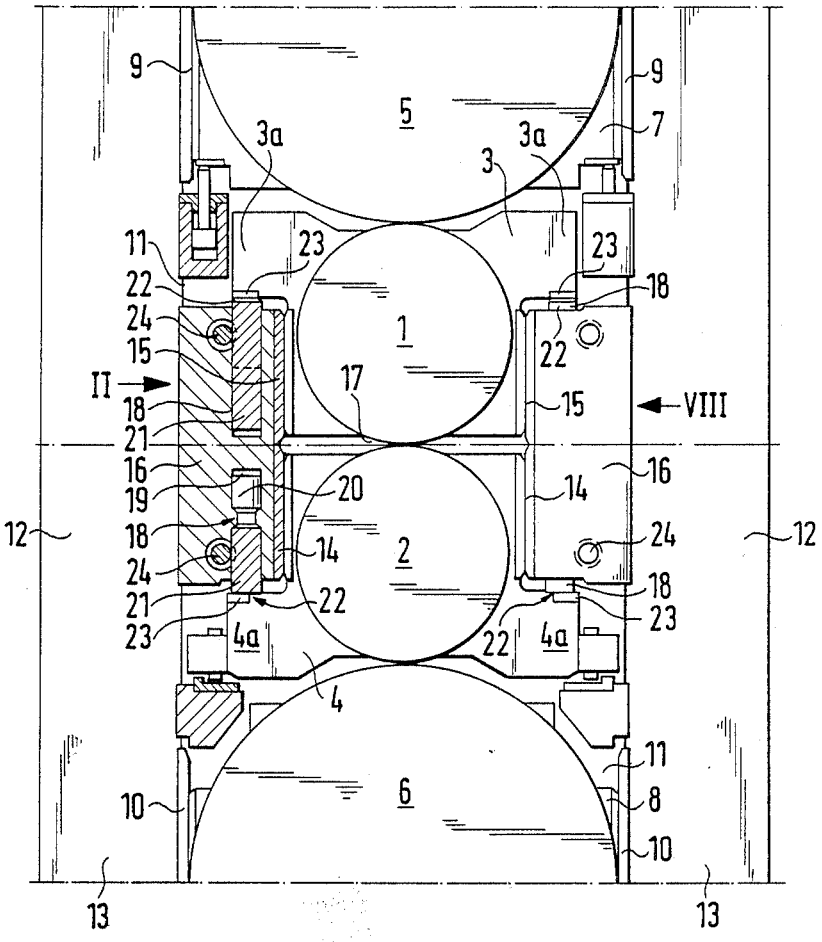
FIG. 1 is an partially axial cross sectional, partially side elevational view of a four roll rolling mill with end pieces as axially slidable intervening pieces.

The basic structure of a four-high rolling mill 1 is partially shown in the drawing. Examples of the bending device 18 according to our invention are described in detail further below.

This rolling mill comprises a pair of working rolls 1 and 2 of which each is supported on two mounts 3 and/or 4. Moreover, the mill comprises a pair of supporting rolls 5 and 6 mounted in supports 7 and/or 8.

The supports 7 and 8 of the supporting rolls 5 and 6 are directly guided between the vertical guiding surfaces 9 and 10 of the window opening 11 on the interior side of the vertical beam 12 of the roll stand 13.

In contrast, the mounts 3 and/or 4 of the working rolls 1 and 2 are located between the vertical guiding surfaces 15 and/or 14 of two blocks 16 which are held locally on the interior side of both upright beams 12 and which project into the window opening 11 of the roll stand 13.

While the supports 7 and 8 for the supporting rolls 5 and 6, displaceable only in the vertical direction, can be displaced between the vertical guiding surfaces 9 and/or 10 of the vertical beams 12, the mounts 3 and/or 4 of both working rolls 1 and 2 relative to the vertical guiding surfaces 15 of the blocks 16 may be displaced both in a vertical and also a horizontal direction parallel to the roll axes.

By the horizontal displaceability of the mounts 3 and 4, it is possible to slide the working rolls 1 and 2 in the axial direction relative to each other and relative to the supporting rolls 5 and/or 6 and thus the rolling mill can be adjusted to work different rolled strip or sheet widths and/or to influence the rolled sheet profile.

The relative axial shifting of the working rolls 1 and 2 is caused by not illustrated sliding or shifting devices provided on the operating side of the rolling mill.

To balance the working rolls 1 and 2 and also to influence the shape of the roll gap 17 formed between them special bending devices 18 according to our invention are required which are provided in both locally fixed blocks 16 and engage on laterally projecting engaging lugs 3*a* and/or 4*a* of the mounts 3 and/or 4 for the working rolls 1 and 2 as can be seen from FIG. 1.

Each of the bending devices 18 comprises at least one bending cylinder 19 with a piston 20 hydraulically actuated and guided in it and an end piece 21 on which the piston 20 of the bending cylinder 19 acts.

The end piece 21 of each bending device 18 is only guided axially slidably in the blocks 16 like the piston 20 in the bending cylinder 19.

Each end piece 21 of the bending device 18 extends inside one of the blocks 16 parallel to the axial direction of the working rolls 1 and 2 over a length which corresponds at least to the maximum possible axial displacement of the working rolls 1 and 2 and/or the mounts 3 and/or 4 supporting them.

Each end piece 21 has a parallel pressing surface 22 running horizontally and directed parallel to the roll axes on its free end and/or the end projecting from the blocks 16. An opposing pressing surface 23 of an engaging lug 3*a* and/or 4*a* of the mounts 3 and/or 4 takes the bending force constantly applied by the pressing surface 22 in the vicinity of the vertical transverse central plane of a radial bearing of the mount 3 and/or 4.

An important structural criteria for the bending device 18 is that the end pieces 21 having the pressing surfaces 22 must be held exactly in a position in which the pressing surfaces maintain their exact horizontal orientation continuously and in every direction over their entire length in every possible operating condition of the rolling mill.

To guarantee lasting effective performance a positively actuated mechanical synchronizing device 24 is inserted between each end piece 21 and the blocks 16 receiving it. The synchronizing device 24 engages at least in both guiding members of the related end piece spaced from each other in the direction of the roll axes.

Figure 2:
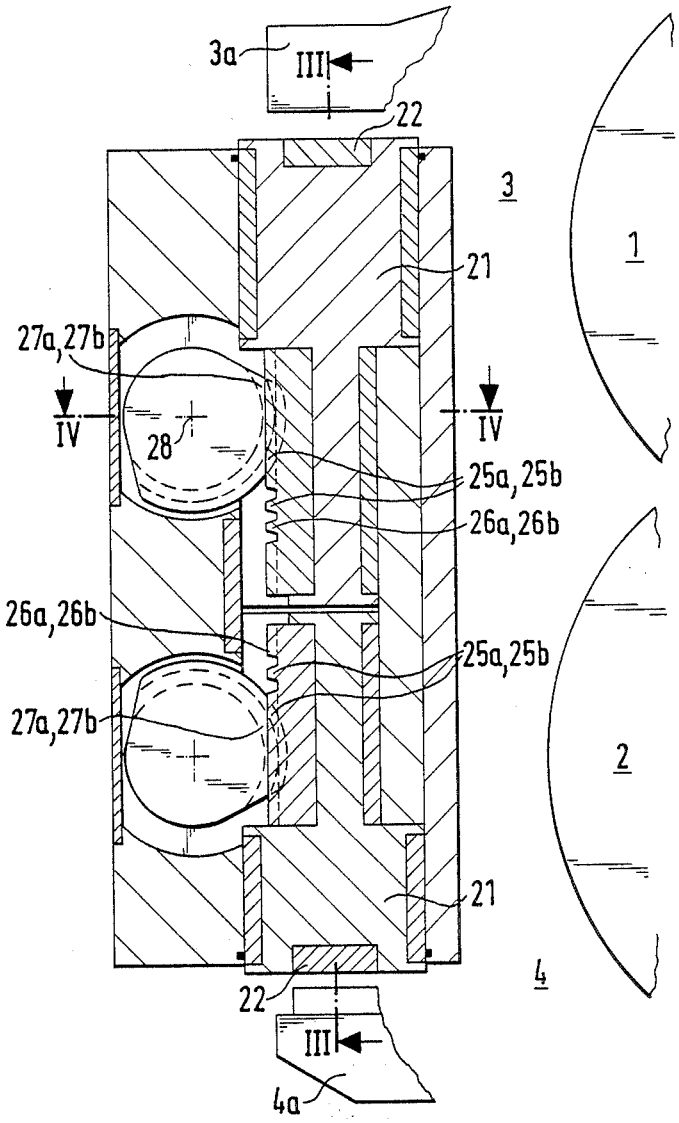
FIG. 2 is an enlarged cross-sectional view of the portion indicated in FIG. 1.
Figure 4:
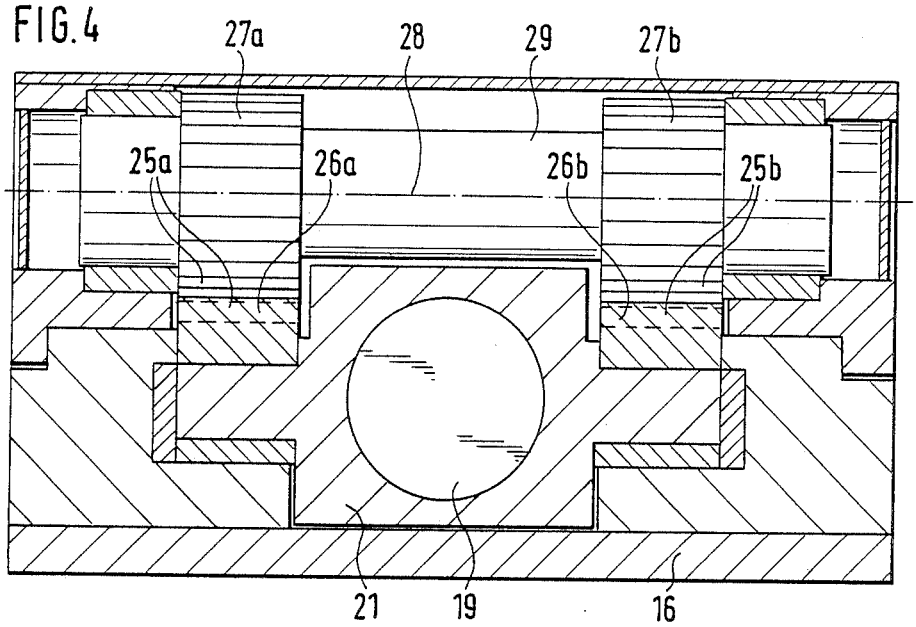
FIG. 4 is a cross-sectional view taken along the section line IV—IV FIG. 2.

It is particularly significant as is apparent from FIGS. 2 and 4, that the positively actuated mechanical synchronizing device 24 comprises a rack and pinion gear 25*a*, 25*b* in which the racks 26*a*, 26*b* sit on and/or are formed on the end pieces 21, while a pinion with rotating teeth 27*a*, 27*b* is mounted rotatable about a fixed axis 28 in the block 16.

Each synchronizing device 24 comprises, as is shown in FIG. 4 two pinions 27*a* and 27*b* attached coaxial to and rigidly by a shaft 29 and the racks 26*a* and 26*b* meshing with them.

The pinions 27*a* and 27*b* are so as to be mounted so as to be freely rotatable in the block 16 by its common shaft 29 while the racks 26*a* and 26*b* meshing with them are rigidly mounted on the axially slidable end pieces 21.

As can be seen from FIG. 1, each end piece 21 of the bending device 18 guided axially slidably in the same block 16 is associated with a single bending cylinder 19 with piston 20 slidable in it. From FIG. 3, both end pieces 21 guided in the same block 16 are associated with a common bending cylinder 19 with the piston 20 slidable in it.

The specific bending cylinder 19 is provided in the upwardly slidable end piece 21 in which the piston 20 slidable in it has a piston rod 20*a* directed downwardly which is coupled with the end piece 21 slidable downwardly in the block 16 by two press seats 20*b* engaged with spherical surfaces in each other and a mounting plate 20*c*. By contrast to the structure of the bending device according to FIG. 1, a further structural simplification is attained by the embodiment of FIG. 3.

As can be seen from FIG. 4, the bending cylinder 19 and the piston 20 belonging to it are associated with both end pieces 21 at the crossing point of their longitudinal and transverse planes and thus assume a symmetrical position to the positively actuated mechanical synchronizing device 24.

Figure 7:
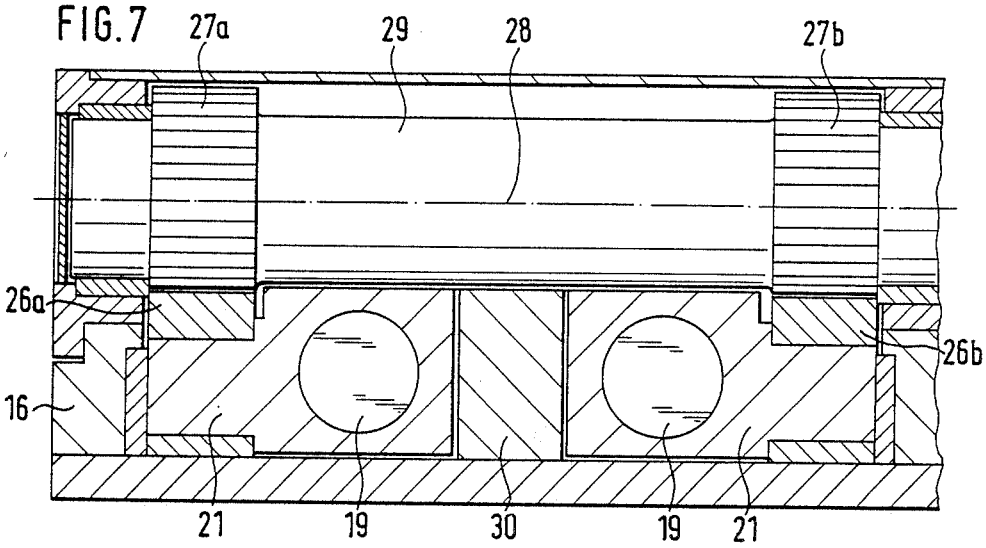
FIG. 7 i cross-sectional view of the bending device taken along section line VII—VII of FIG. 5.
Figure 5:
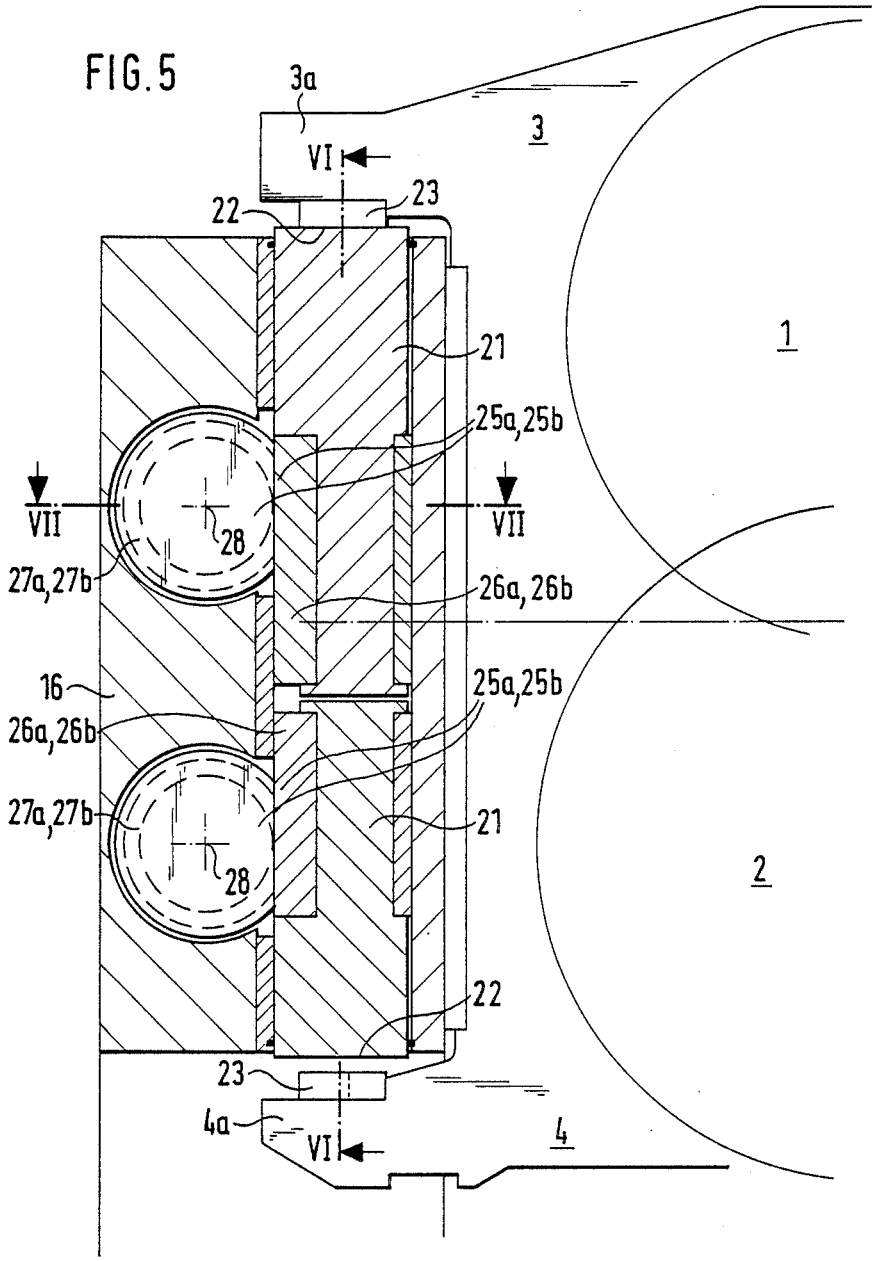
FIG. 5 is a cross-sectional view corresponding to FIG. 2 of an al construction of the bending device.
Figure 6:
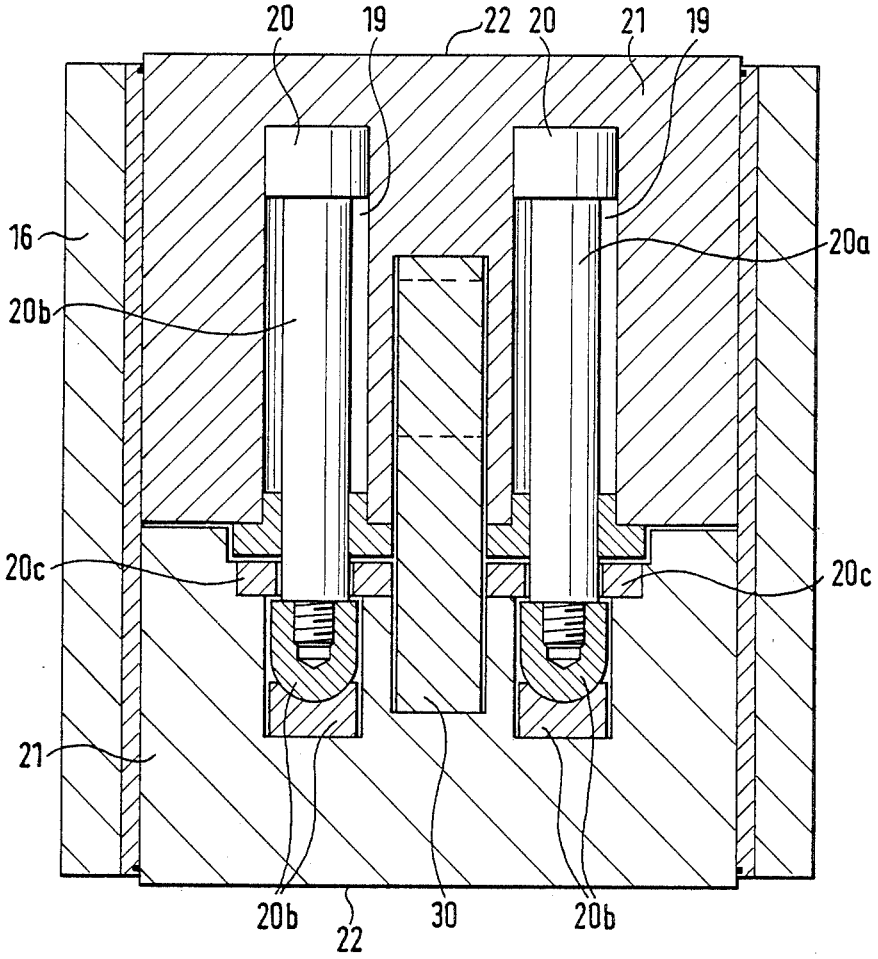
FIG. 6 cross-sectional view of the bending device taken along section line VI—VI of FIG. 5.

In FIGS. 5 to 7 of the drawing bending devices 18 for the working rolls 1 and 2 are shown which are different from those according to FIGS. 2 and 4 in their basic structure only since both end pieces 21 positioned in the same block 16 are not operated together by one bending cylinder 19 and associated piston 20 but are equipped with two parallel bending cylinders 19 and pistons 20 slidable in them. These are located symmetrically on both sides of a transverse central plane of the block 16 and an additional guide beam 30, especially with a rectangular cross section, is installed between them to work together with both end pieces 21. This guide beam 30 can unload the piston rods 20*a* from lateral forces when both end pieces 21 are moved from each other.

Figure 3:
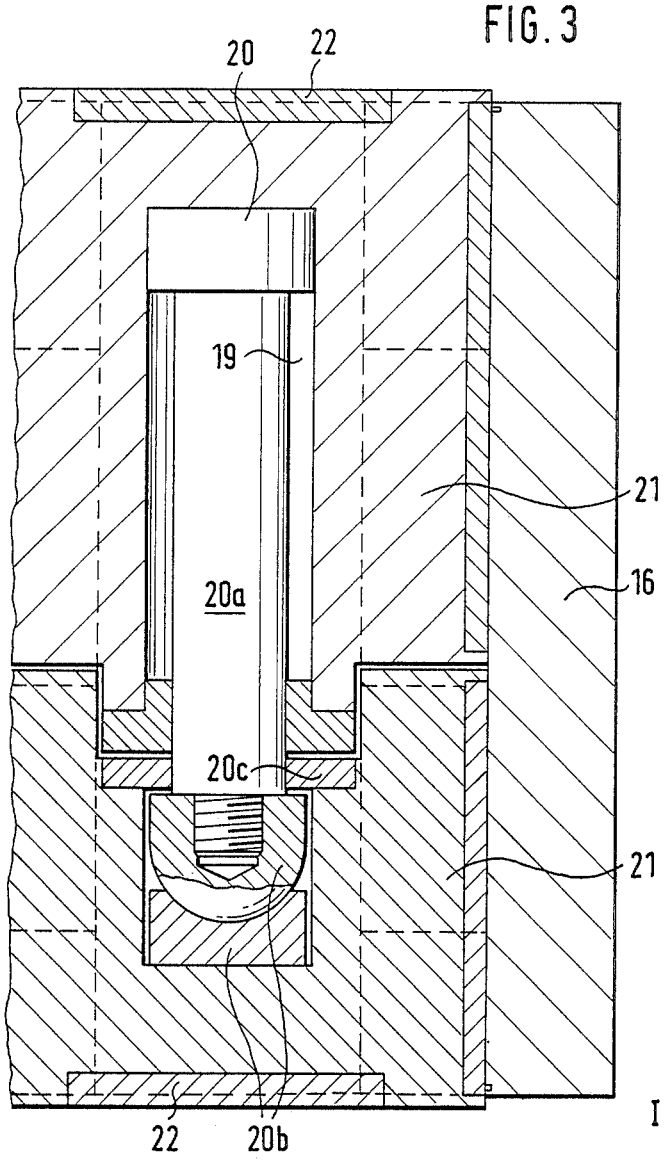
FIG. 3 is a cross-sectional view of a part of the rolling mill taken along the section line III—III of FIG. 2.

While the form of the bending devices according to FIGS. 2 to 4 is particularly suitable for the case in which there are comparatively small structural dimensions for the blocks 16 in the direction of the roll axis, the structure according to FIGS. 5 to 7 is particularly useful when the block 16 has comparatively large dimensions in the direction of the roll axis and a comparatively large bending force must be exerted by the bending devices on the working rolls.

The structural dimensions of the block 16 in the structure according to FIGS. 5 to 7 parallel to the roll direction can correspond to those in the structure according to FIGS. 2 to 4.

Figure 8:
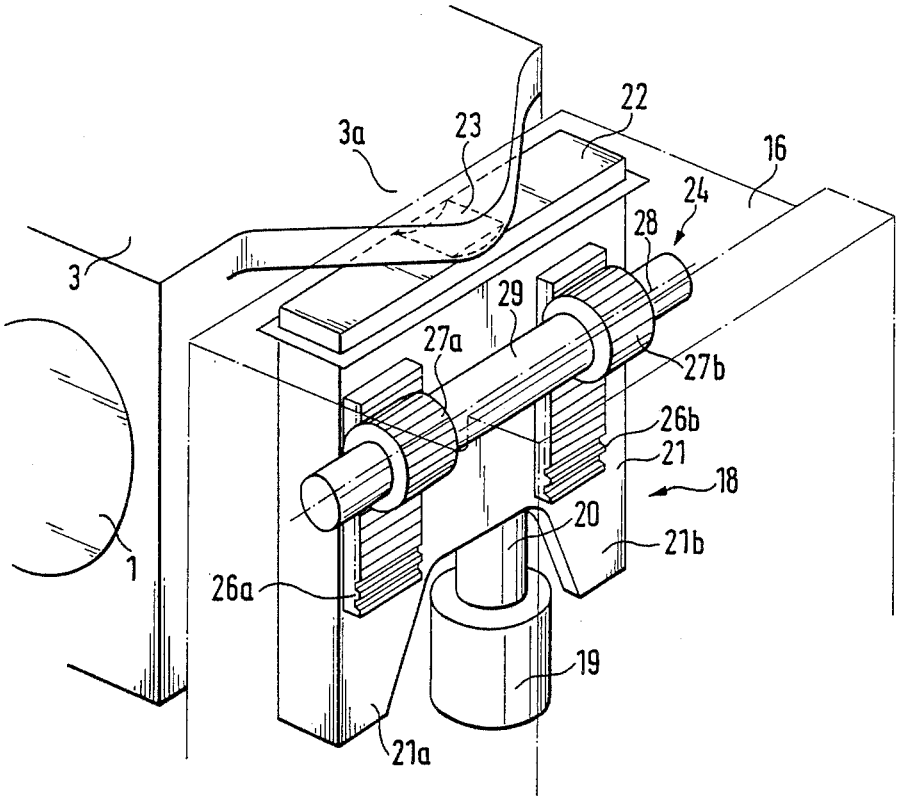
FIG. 8 is a cross-sectional view of the bending the upper portion of the lateral blocks indicted at VIII in FIG. 1 with the bending device mounted on it.

In FIG. 8 a perspective view to an enlarged scale show a bending device 18 mounted on a block 16 whose basic structure corresponds with that according to FIG. 1. Thus the positively actuated mechanical synchronizing device 24 is apparent which supports both pinions 27*a* and 27*b* rigidly mounted on a shaft 29 pivotally mounted in the block 16. These pinions 27*a* and 27*b* mesh permanently with both racks 26*a* and 26*b* which are attached rigidly with the end pieces 21 and are guided exclusively vertically slidably in block 16.

From FIG. 8, it is also apparent that each end piece 21 has guiding members 21*a* and 21*b* which extend past bending cylinder 19 located centrally between them in the block 16 directed into the block 16 and/or to the rear in the vicinity of its guiding section, also in the vicinity of both toothed members 26*a* and 26*b* attached to it.

In this way, displacement characteristics of the end pieces 21 are essentially improved with the best possible use of the available space in the structure.

In FIG. 8 again, it is seen that the opposing pressing surface 23 of the mount 3 has a rounded raised portion coincident with the central transverse plane of the support which is appropriately formed by replaceable wear piece. In this way, it is guaranteed that the position of the mount 3 and/or 4 for the working rolls 1 and 2 corresponding to a particular bending deformation of the working rolls 1 and/or 2 can be set opposite the blocks 16 and/or the end pieces 21.

Figure 9A:
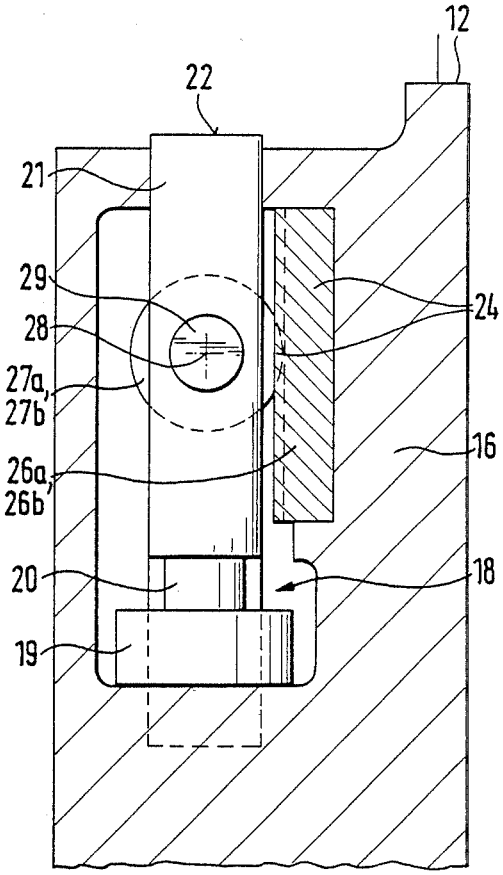
FIGS. 9*a* and 9*b* are vertical cross-sectional views through the a block indicated in FIG. 8 but with a different example the bending device in it.

In FIG. 9*a*, a bending device 18 having a different structure from the bending device of FIG. 8 is shown in vertical cross section.

The difference in structure comprises that the pinions 27*a*, 27*b* of the positively actuated mechanical synchronizing device 24 be supported freely rotatably in the end piece 21 by the shaft 29 rigidly attached with each other, while the associated racks 26*a* and 26*b* are mounted locally fixed in one of the blocks 16.

Thus a kinematically inverted arrangement of the functioning elements forming the synchronizing device 24 as opposed to the structure of FIG. 8 results. The basic operation of the embodiment of FIG. 9*a* is, however, the same as that of FIG. 8.

Figure 10:
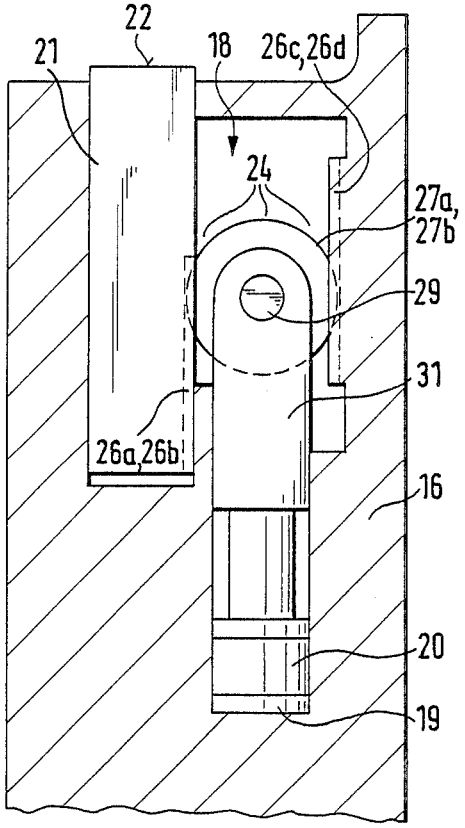
FIG. 10 is a vertical cross-sectional view similar to FIG. 9*a* of an --ve structure for a working-roll-bending device to our invention.

FIG. 10 shows another possibility for the bending device 18 according to our invention, which is different from that shown in FIG. 9*a*. In this case, the structure is such that the hydraulically actuated piston 20 of the bending cylinder 19 acts on the end pieces 21 guided axially slidably in one of the blocks 16 by the positively actuated mechanical synchronizing device 24.

The shaft 29 is rotatably mounted in an axially slidable sliding piece 31 with the pinions 27*a*, 27*b* placed nonrotatably on it. The pinions 27*a*, 27*b* mesh with the racks 26*a*, 26*b* on the end piece 21. The pinions 27*a*, 27*b* sit in diametrically opposed positions of its periphery in engagement with toothed bars 26*c* and 26*d* which are rigidly attached or located in the locally fixed block 16.

The positively actuated mechanical synchronizing device 24 is used at the same time as a differential gear which is connected between the bending cylinders 19 and/or its pistons 20 and the end piece 21.

Such a structure for the bending device 18 is especially desirable when a bending cylinder 19 with a comparatively small piston displacement is used, but a large displacement of the end pieces 21 in the heavy block 16 must be provided.

Figure 9B:
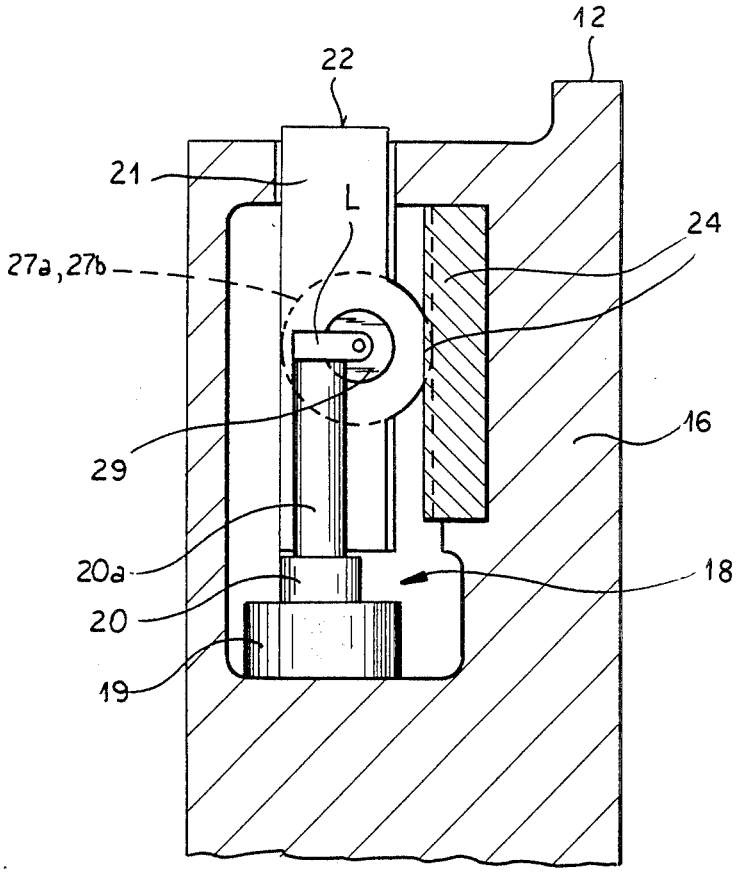

In the bending device 18 the shaft 29 with the pinions 27*a*, 27*b* of the synchronizing device 24 according to FIG. 9*b*, can be pivotally mounted in the end piece 21, while the toothed members 26*a*, 27*b* locally fixed in the block 16. The hydraulically actuated piston 20 of the bending cylinder 19 may be engaged to a lever arm L with the shaft 29 rigidly attached by piston rod 20*b*. In this way in the embodiment of FIG. 9*b*, the displacement of the end piece 21 occurs.

Such a structure has proven suitable when the bending cylinder 19 with its piston 20 cannot be accommodated inside the heavy block 16 but instead of this must be located on the outside of the roll stand 13.

Figure 11:
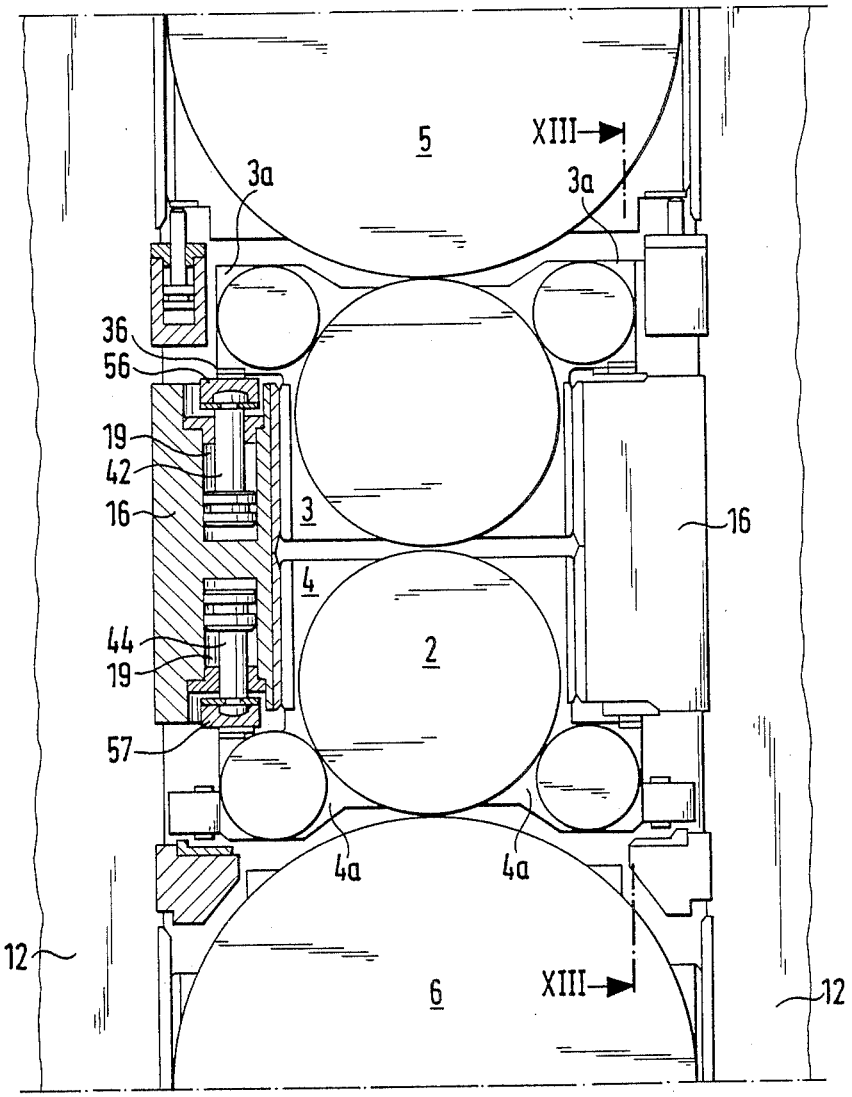
FIG. 11 cross-sectional, partially side-elevational of a rolling mill with pressing bridge members as axial -lidable intervening pieces.

Reference numerals for the four-high rolling mill according to FIG. 11 correspond to those used in FIG. 1. One or two pairs of equal axis bending cylinders 19 are provided in a heavy block 16 since it is a matter of a bending device for the working rolls. It is understood that a bending device for intermediate rolls for each heavy block 16 could have one or a pair of bending cylinders 19 acting in the same direction. The bending device shown in FIG. 11 is very similar to the bending device in FIGS. 12 to 15.

Figure 12:
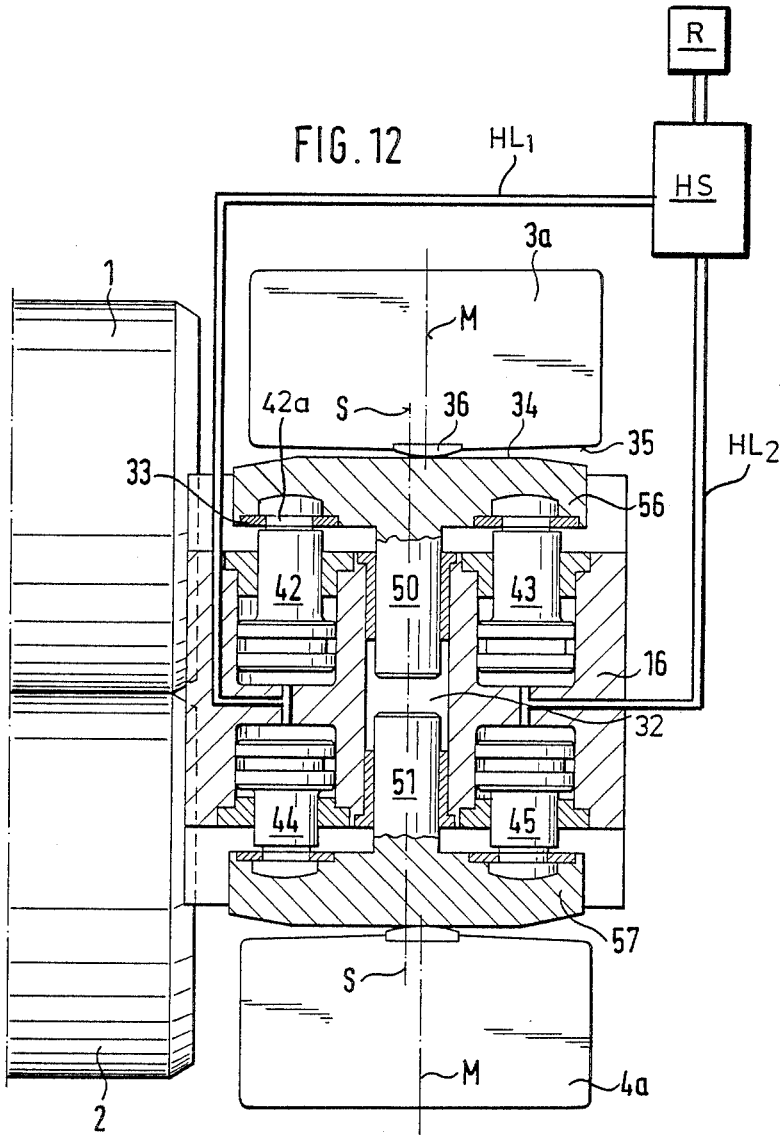
FIG. 12 a vertical cross-sectional view of one end of two working rolls through the bending device for these

The one end of the working rolls 1,2 with the engaging lugs 3*a*, 4*a* of their mounts overlapping a bending device is shown in FIG. 12. Each heavy block 16 is provided with two pairs of coaxial hydraulically activated pistons 42, 44 and/or 43, 45, i.e. pistons 42, 43 and/or 44, 45 side-by-side are pairwise equally effective and exert common bending forces for bending the working rolls.

Each pair of pistons acting in the same direction is covered by a common pressing bridge member 56, 57. Each pressing bridge member has a fitting central bolt 50 and/or 51 in a symmetry plane S symmetric to the coaxial pairs of pistons which are guided in a common passage 32 with a small amount of play so that the pressing bridge members 56, 57 are fed or guided without error.

The pressing bridge members 56, 57 are pressed—as FIG. 12 shows for the pistons—by spring rings 33 which engage in the circular grooves 42*a* of the pistons and are screwed into the pressing member bridges attached with the pistons.

The pressing bridge member 56 (and likewise the lower pressing member bridge 57) has a planar pressing transmitting surface 34 against which the opposing pressing surface 35 of the engaging lugs 3*a*, 4*a* which is spherical and symmetrical with respect to a central plane M presses.

The central plane M defines the central plane of the radial bearing of the mounts which is displaced somewhat to the right away from the locally fixed symmetry plane S because the rolls 1, 2 and the engaging lugs 3*a*, 4*a* are slid to the left from the central axial position by an axial adjustment. It is to be noted that in fact an opposing adjustment of the working rolls in question takes precedence.

The opposing pressing surface 35 is provided with a hardened wear piece 36 on the central plane M. This also is true for the lower engaging strap 4*a*.

The spherical shape of the opposing pressing surfaces 35 and particularly the wear pieces 36 guarantees that the bending force exerted by the piston pairs 42,43 and/or 44,45 acting in the same direction is continuously transferred in the central plane M of the bearing, of course resulting in a tilting torque or moment acting on the pressing bridge members 56, 57 which is unaffected by the exact round bolt feed of the pressing bridge members 56, 57 so that the pressing bridge members are guided tilt free.

To additionally relieve or discharge the round central bolts 50, 51 from their task of tilt-free guiding of the pressing member, bridges 56, 57 during large deviations of the locally fixed symmetry plane S from the central plane M, the variable bending force is changeable in the opposite direction pistonwise to the action of the pistons to act on one of each pair of pistons 42, 43 and/or 44, 45 so that on axial shifting the central plane M from the symmetry plane S as a result of the axial shifting of the rolls the central bolts 50, 51 in the associated heavy blocks 16 are guided moment free.

This can be accomplished by an hydraulic synchronizing device HS which can include a pump and an attached reservoir R. This synchronizing device HS provides hydraulic fluid at different pressures in the lines $HL_1$ and $HL_2$ to the right or left piston shown in FIG. 12 to provide a tilt-free guiding of the pressing bridge members 56, 57.

Figure 13:
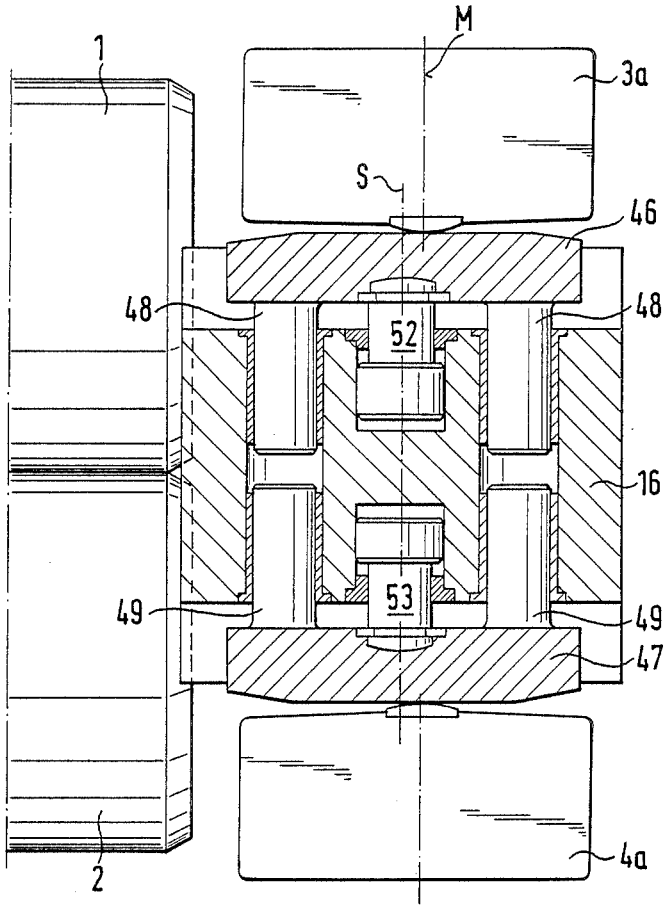
FIG. 13 is a vertical cross-sectional view of one end of two working rolls through a bending device according to our invention d from that of FIG. 12.

The embodiment according to FIG. 13 differs from that according to FIG. 12, only in that a single pair of oppositely directed piston 52, 53 are provided in the symmetry plane S in one heavy block 16 only which are covered by pressing bridge members 46,47. Guiding members which are the round guide bolts 48 and 49 positioned symmetrically to the symmetry plane S are attached or formed on these pressing bridge members 46, 47.

Figure 14:
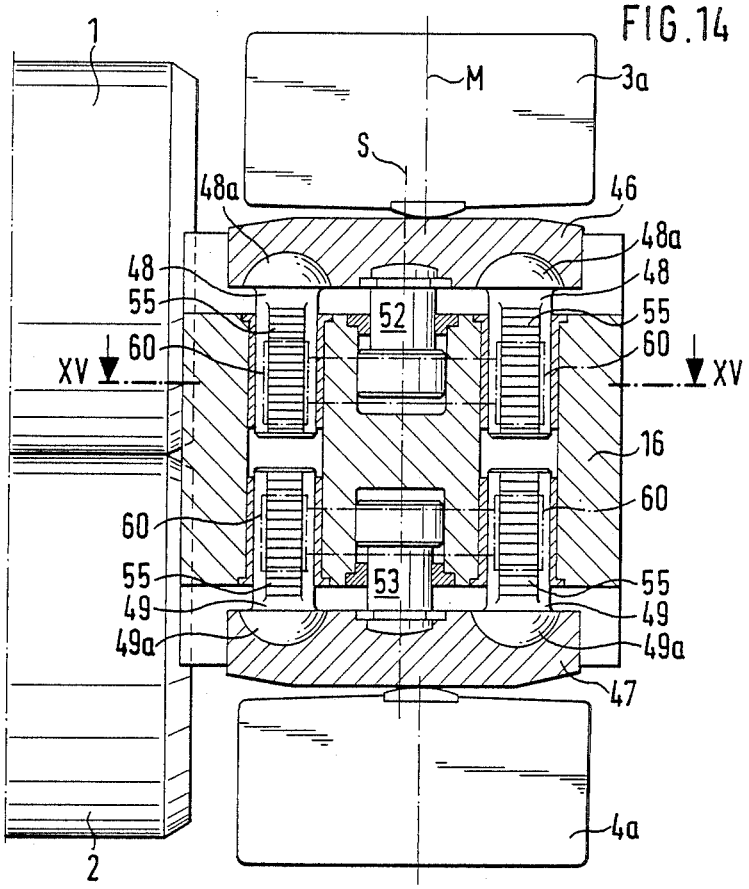
FIG. 14 is a vertical cross-sectional view similar to that of FIG. 13 taken along the section line XIV—XIV of FIG. 15.
Figure 15:
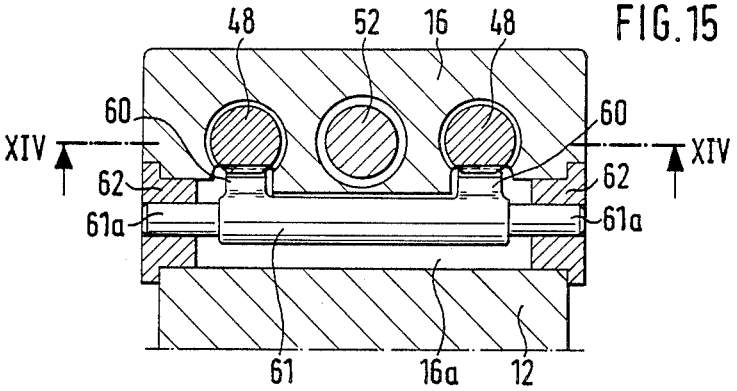
FIG. 15 is a horizontal cross-sectional view of the bending device and rolling mill of FIG. 14 taken along the section line XV—XV of FIG. 14.

In bending device of FIG. 14, is similar to that of FIG. 13, but with the difference that the round guide bolts 48 and 49 are provided with rack-like teeth 55. Opposite the drawing plane, pinion elements 60 mesh in these toothed members 55 as is seen better in FIG. 15.

A pair of coaxial pinion elements 60 is attached by a synchronizing shaft 61 so that the round bolt pairs 48 and the round bolt pairs 49 are mechanically synchronized in the sense of running cooperatively. Also this relieves the round bolts 48, 49 with respect to the receipt of bending moments or torques which can act on the pressing bridge members 46, 47 according to the axial position of the working rolls 1, 2 on the mount side of the engaging lugs 3*a*, 4*a*.

The synchronizing device provides a torsion of the synchronizing shaft to avoid formation of forces otherwise required by the connection between the pressing bridge members and the round bolts.

The round bolts are shown schematically with spherical heads 48*a* and/or 49*a* in corresponding spherical seats of the pressing bridge members. Understandably, the pressing bridge members 46, 47 can be connected with pivoting links with the round bolts 48, 49.

Each of the heavy blocks 16 has transverse passages 16*a* (FIG. 15) which are sufficiently large enough so that the synchronizing shaft 61 with the pinion elements 60 can be mounted laterally in the highest possible position. On guiding in the round bolt 48 into the device the toothe members 55 of this bolt can be brought into engagement with the teeth of the pinion elements 60 by rotation of the synchronizing shaft 61. The synchronizing shaft 61 is provided with a journal 61*a* at both of its ends by which the synchronizing shaft 61 is held in the covers 62 closing the passage 16*a*.

It is to be noted that the stand-supported bending devices according to our invention which transmit hydraulic forces, particularly are designed for relatively small axial displacement of the working rolls. Such small axial displacements result in not very large differences in the width of the rolled flat material during axial shifting of the working rolls when rolls with the nearly cylindrical contour described in German Pat. No. 30 38 865 are used or also on cyclically-opposing shifting of the working rolls to avoid local roll wear in the vicinity of the strip edges.

We claim:

1. A rolling mill stand comprising:

a pair of uprights formed with respective windows;

a pair of working rolls and at least one pair of backup rolls disposed above and below said working rolls and received between said uprights, said rolls being rotatable about respective axes of rotation parallel to one another and at least said pair of working rolls being axially slidable relative to said uprights;

axially slidable mounts journaling opposite ends of said working rolls in said windows, said mounts being formed with respective pairs of lugs extending horizontally laterally, each of said lugs having a counterpressure surface located at a transverse central plane of a radial bearing formed by the respective mount;

at least one supporting block in each of said windows anchored to said uprights and located between respective lugs of each pair of said mounts in a respective window, said supporting blocks guiding said mounts horizontally and vertically;

at least one vertically displaceable piston-and-cylinder unit in each of said blocks producing bending forces for bending said working rolls; and bending force transmitting means in each of said blocks shiftable vertically and operatively connected with the respective piston-and-cylinder unit for transmitting said bending forces to the lugs, each of said transmitting means including a ram-shaped member guided independently from the respective piston-and-cylinder units and having a substantially horizontal pressing surface in continuous contact with the respective counterpressure surface, said ram-shaped members projecting from the respective supporting blocks over lengths parallel to said axes equal at least to a maximum axial displacement of said pair of working rolls and being so guided linearly on the respective blocks that said piston-and-cylinder units are free from transverse forces and provide the respective mounts with a continuous, constant and tilt-free transfer of said bending forces from said units.

2. The rolling mill defined in claim 1 wherein each of said members is a pressing bridge member acted upon by two piston-and-cylinder units.

3. The rolling mill defined in claim 1 wherein each of said supporting blocks comprises a plurality of central bolts located along an axis of symmetry of the respective supporting block and guiding the respective one of said members.

4. The rolling mill defined in claim 1 wherein said counterpressure surfaces are formed with replaceable wear pieces having a spherical surfaces facing toward said pressing surfaces means.

5. The device defined in claim 1 wherein said counterpressing surfaces are curved.

6. In a bending device for the axially slidable rolls of a multiroll rolling mill with at least four of said rolls which is located in at least one supporting block guiding a plurality of mounts for said axially slidable rolls, said bending device comprising at least one bending cylinder with an hydraulically actuated piston for each of said supporting blocks which transmits the bending forces to one of at least two laterally extending engaging lugs of said mount, the improvement wherein an intermediate piece is positioned between said piston and said mount, said intermediate piece having a planar substantially horizontal pressing surface directed parallel to the roll axes on the end of said intermediate piece projecting from said block which extends at least over the maximum displacement of said axially slidable rolls and said mount is provided with an opposing pressing surface for receipt of said bending forces which is located at a transverse central plane of a radial bearing formed by said mount, two guiding members being provided on said intermediate piece spaced from each other in the direction of said roll axes located symmetrically relative to a symmetry plane of said piston, said intermediate piece being coupled with said block by a positively actuated mechanical synchronizing device, said positively actuated synchronizing device comprising a rack and pinion gear which includes at least one rack and at least one pinion meshing therewith and supported slidably relative thereto.

7. The improvement according to claim 6 wherein said opposing pressing surface on said mount is spherical and is provided by a replaceable wear piece.

8. In a bending device according to claim 6 in which said intermediate piece is a pressing bridge member, the improvement wherein each of said guiding members is a round guide bolt.

9. The improvement according to claim 8 wherein said pressing bridge member is attached pivotally with said round guide bolts.

10. In a bending device according to claim 6 having a pair of said pistons acting in the same direction for each of said supporting blocks, the improvement comprising a plurality of central bolts located on a symmetry plane of said pistons in each of said intermediate pieces which is a pressing bridge member.

11. In a bending device according to claim 10 with variable ones of said bending forces acting on said pistons, the improvement wherein said bending force for an individual one of said pistons of said pair of said pistons acting together in the same direction associated with each of said intermediate pieces is changeable by a hydraulic synchronizing device so that during a shift of said central plane of said radial bearing of said mount from said symmetry plane of said piston because of an axial shifting of said rolls said central bolts or other guiding members are guided moment free in said block.

12. The improvement according to claim 6 wherein said pinion meshing with said rack is freely rotatable by a common shaft in one of said intermediate pieces which is an end piece while said toothed linear member sits rigidly on one of said blocks.

13. The improvement according to claim 6 wherein said synchronizing device comprises at least two of said pinions mounted coaxially and rigidly on a shaft and two of said racks meshing with said pinions.

14. The improvement according to claim 13 wherein said pinions are rotatably mounted on said shaft which is common to both in said block, while said racks are rigidly attached at said intermediate piece which is an end piece or said round guide bolts.

15. The improvement according to claim 14 wherein each of said end pieces has guiding members directed into said block which are guided past said bending cylinder in said block.

16. The improvement according to claim 13 wherein said hydraulically actuated piston of said bending cylinder is engaged on said intermediate piece which is an end piece by said synchronizing device.

17. In a bending device according to claim 16 in which said shaft with said pinions of said synchronizing device is rotatably mounted in said end piece and said racks are located on said blocks, the improvement wherein said hydraulically actuated piston of said bending cylinder engages on a lever arm attached nonrotatably to said shaft.

18. The improvement according to claim 16 wherein said shaft with said pinions of said synchronizing device is rotatably mounted on a sliding piece and each of said pinions is engaged on one side with said racks on said end piece which is slidable and on the other side diametrically opposed with said racks on said block.

19. A bending device for the axially slidable rolls of a multiroll rolling mill with at least four of said rolls, said bending device being mounted in at least one supporting block of said rolling mill and said axially slidable rolls being mounted in a plurality of axially slidable mounts of said axially slidable rolls said bending device comprising:

at least one bending cylinder with a hydraulically actuated piston for each of said blocks which transmits bending forces to said mounts;

at least one end piece positioned between said piston and said mount having a planar substantially horizontal pressing surface directed parallel to the roll axes of said rolls on the end of said end piece projecting from said block which extends at least over a maximum displacement of said axially slidable rolls, said mount being provided with an opposing pressing surface having a replaceable wear piece attached thereto for receiving said bending forces which is located at a transverse central plane of a radial bearing of said mount; and a positively actuated synchronizing device comprising a rack and pinion gear coupling said end piece with said supporting block, said rack and pinion gear including at least two racks attached rigidly to each of said end pieces and at least two pinions mounted rigidly on a common shaft freely rotatable in said block.

20. A bending device for the axially slidable rolls of a multiroll rolling mill with at least four of said rolls, said bending device being mounted in at least one supporting block of said rolling mill and said axially slidable rolls being mounted in a plurality of axially slidable mounts of said axially slidable rolls, said device comprising:

at least one bending cylinder with a hydraulically actuated piston for each of said blocks which transmits the bending forces to one of said mounts;

at least one pressing bridge member positioned between said piston and said mount having a substantially horizontal pressing surface directed parallel to roll axes of said rolls on an end of said pressing bridge member projecting from said block which extends at least over a maximum displacement of said axially slidable rolls, said mount being provided with an opposing pressing surface having a replaceable wear piece attached thereto for receiving said bending forces which is located at a transverse central plane of a radial bearing of said mount;

two round guide bolts attached to each of said pressing bridge members spaced from each other in a direction of said roll axes located symmetrically relative to a symmetry plane of said piston penetrating said block; and a positively actuated synchronizing device comprising a rack and pinion gear coupling said pressing bridge member with said supporting block, said rack and pinion gear including at least two racks each mounted on one of said round guide bolts and at least two pinions mounted rigidly on a common shaft freely rotatably in said block.

* * * * *